US008557109B1

(12) United States Patent
Sutherland

(10) Patent No.: US 8,557,109 B1
(45) Date of Patent: Oct. 15, 2013

(54) DRAIN COVER FOR GENERALLY OPEN FLAT DRAINAGE AREAS WITH DEBRIS BLOCKAGE AND OPEN DRAINAGE PORTIONS

(76) Inventor: Mark Sutherland, Chicago, IL (US)

( * ) Notice: Subject to any disclaimer, the term of this patent is extended or adjusted under 35 U.S.C. 154(b) by 0 days.

(21) Appl. No.: 13/614,043

(22) Filed: Sep. 13, 2012

(51) Int. Cl.
*E03F 5/14* (2006.01)

(52) U.S. Cl.
USPC ..... 210/163

(58) Field of Classification Search
None
See application file for complete search history.

(56) References Cited

U.S. PATENT DOCUMENTS

| | | | | |
|---|---|---|---|---|
| 853,598 | A * | 5/1907 | Rile | 210/166 |
| 1,791,512 | A * | 2/1931 | Schurman | 210/163 |
| 1,999,277 | A * | 4/1935 | Boosey | 210/163 |
| 4,035,297 | A * | 7/1977 | Aldridge et al. | 210/163 |
| 4,525,273 | A * | 6/1985 | Logsdon | 210/164 |
| 4,655,913 | A * | 4/1987 | Boersma | 210/163 |
| 5,141,633 | A * | 8/1992 | Walczak et al. | 210/163 |
| 5,234,582 | A * | 8/1993 | Savoie | 210/163 |
| 5,394,657 | A * | 3/1995 | Peterson | 52/12 |
| 5,469,670 | A * | 11/1995 | Thaler | 52/12 |
| 5,618,416 | A * | 4/1997 | Haefner | 210/163 |
| 5,650,065 | A * | 7/1997 | Sewell | 210/166 |
| 5,689,928 | A * | 11/1997 | Rasksen | 52/302.1 |
| 5,735,091 | A * | 4/1998 | Hawkins et al. | 52/302.7 |
| 5,843,306 | A * | 12/1998 | Singleton | 210/163 |
| 5,966,884 | A * | 10/1999 | Uglow | 52/302.1 |
| 6,004,457 | A * | 12/1999 | Singleton | 210/163 |
| 6,165,357 | A * | 12/2000 | Cormier | 210/163 |
| 6,261,445 | B1 * | 7/2001 | Singleton | 210/163 |
| D460,810 | S * | 7/2002 | Sommerhein | D23/261 |
| 6,416,674 | B1 * | 7/2002 | Singleton et al. | 210/747.3 |
| 6,428,693 | B2 * | 8/2002 | Singleton | 210/163 |
| 6,453,482 | B1 * | 9/2002 | Mullings | 4/507 |
| D466,198 | S * | 11/2002 | Mullings | D23/261 |
| 6,588,029 | B2 * | 7/2003 | Mullings | 4/507 |
| 6,631,588 | B1 * | 10/2003 | Distler | 52/12 |
| 7,300,573 | B1 * | 11/2007 | Trangsrud | 210/163 |
| 7,407,574 | B2 * | 8/2008 | Robinson | 210/163 |
| 7,854,838 | B2 * | 12/2010 | Martin | 210/163 |
| 8,043,497 | B2 * | 10/2011 | Silverstein et al. | 210/164 |
| 8,158,010 | B2 * | 4/2012 | Pearse et al. | 210/747.1 |
| 2001/0023842 | A1 * | 9/2001 | Singleton | 210/163 |
| 2007/0205144 | A1 * | 9/2007 | Robinson | 210/163 |
| 2008/0308476 | A1 * | 12/2008 | Silverstein et al. | 210/163 |
| 2010/0025312 | A1 * | 2/2010 | Martin | 210/170.03 |
| 2011/0253641 | A1 * | 10/2011 | Pearse et al. | 210/747.3 |
| 2012/0222996 | A1 * | 9/2012 | Rennels | 210/163 |

* cited by examiner

*Primary Examiner* — Robert James Popovics
(74) *Attorney, Agent, or Firm* — Dennemeyer & Associates, LLC.

(57) ABSTRACT

A drain cover having a main drainage surface with relatively larger apertures or openings therein, comprising generally 50 percent of the surface, so that larger debris is accepted into a related drain pipe when a depending skirt portion of the drain cover, having smaller perforations, becomes clogged. In this way a two-layer drainage system for a generally flat surface is provided that allows draining of water and small particulates alone when possible, but upon the clogging of the smaller openings the generally flat surface can be protected from flooding by allowing larger particulates to drain into the main drainage surface. The main drainage surface is held above the flat surface by the depending skirt, at a level of ⅜ to 1 inch above the flat surface. When the depending skirt openings are clogged the water and debris will rise until allowed to drain into the larger openings of the main drainage surface.

7 Claims, 7 Drawing Sheets

DRAIN COVER FOR GENERALLY OPEN FLAT DRAINAGE AREAS WITH DEBRIS BLOCKAGE AND OPEN DRAINAGE PORTIONS

FIELD OF THE INVENTION

The present invention concerns a drain cover for use on drainage pipes that are within generally open flat surfaces prone to flooding. More particularly the present invention concerns a drain cover having a generally flat surface, open to a drainage pipe and a skirt depending from the flat surface for drainage of water even in the presence of debris that otherwise would block the drain. The skirt and flat surface portions of the drain cover each overlying the surface to be drained in a manner that permits drainage while preventing flooding due to the blockage of drain holes. The device in a preferred embodiment is used outside of a walk-out basement or another entry door that is close to or, below grade and as such is prone to flooding. Further, the device can also be adapted for use within drains in window-wells.

BACKGROUND OF THE INVENTION

Presently there are drain covers for use on driveways, patios, walk-out basement doors below grade, interior spaces, window wells and other dry land flat surfaces that are subject to flooding. Most such drain covers have a generally circular planar shape with either holes or slots therein to permit water to drain there through while preventing debris from entering the drainage pipe and water removal systems. Such drains are typically connected, via pipes, to storm sewer or other water removal systems. While it is desirable to remove water alone from such surfaces, often times the surfaces will have leaves, grass, soil and other debris thereon. Municipalities typically are desirous that only water be permitted through to storm sewer systems; in order to accomplish this, the drain covers are typically generally solid with small perforations thereon to allow water, and only tiny particles of debris, to enter and proceed to the storm sewer.

In certain situations, municipalities must make some allowance for the entry of debris into water removal systems, or risk dangerous flooding. For example, on road surfaces, the presence of water can result in dangerous hydroplaning and other flooding conditions causing safety hazards. For those situations culvert drainage systems have been developed wherein a drain is placed against an elevated curb, with a partially open top surface and a depending perforated skirt. However, these types of drains are only possible against curbs as the skirt portion is typically quite elevated (so as to be effective only during periods of high water) and would prove a high obstacle on a flat surface. Patents covering these types of culvert systems and systems for treating water runoff from such, include U.S. Pat. Nos. 7,534,355, Lockeiman et al. *Storm Drain Filter With Variable Flow Capacity*; and 8,017,004, Crumpler, *Storm Drain and Filter System*; and 7,332,091, Peters, Jr. et al., *Process for Treating Storm Water*. Each of these shows variable sized openings but are of a type that can only be used in the side of the curb on a roadway, due to their large size and shape and which could not be adopted for flat surface use.

However, in areas of generally open flat areas, such as patios and driveways that are in proximity to a house or other structure, the use of drains that have small holes or slots so as to permit drainage of water alone, often cause flooding situations when the small holes or slots become blocked by debris. This flooding has deleterious effects on the nearby house or structure and/or other property, causing damages that are often measured in the thousands of dollars. The allowance of leaves or other debris into storm sewers or other drainage systems can be otherwise managed and would cause less damage than that otherwise suffered. For example, U.S. Patent Application Publication No. 2005/0247612, Glassheim, *Silt and Debris Filtering System for Storm Drains*, tries to solve the problem by capturing the large debris within a drain, but there is a requirement for the user to occasionally come and clear out the debris trap, and in the interim flooding can occur. Further, the device shown is more appropriate for use at curbside or within a storm sewer system, as the device is placed at the opening of the drain within the storm sewer and likely would not fit within a smaller drain used on a flat surface. U.S. Pat. No. 6,793,811, Fleischmann, *Runoff Drain Filter with Separately Removable Cartridges*, shows a more modern approach to run off filters, but suffers the same issues and is also not appropriate to flat surface drainage. Further, the height of drains used on flat surfaces, particularly those where automobile or pedestrian traffic is common, must be low profile so that the drain covers do not prove an impediment or hazard to automobiles or pedestrians traversing the flat surface.

It would be desirable to have a drain cover that would block debris from entering a storm sewer system until the threat of flooding occurs and thereafter concomitantly permit drainage of large debris until the threat is alleviated.

In the past, some surface drains have been made of a type having small openings to permit water and small debris to enter and which are typically mounted such that the top surface of the drain cover is flush with the surface to be drained. For example, U.S. Pat. No. 4,655,913, Boersma, *Adjustable Drain Cove* and Design patent No. 256,948, Boersman, Drain Cover, presents drains wherein small holes are provided for drainage, the device including means to adjust the fit of the cover within the pipe from outside of the cover. However, the '913 and '948 patents suffer the problem that when debris is brought towards the drain, with the natural flow of water, these drains will likely be clogged allowing the surface to flood. In U.S. Pat. Nos. 134,978, Clapp, *Gratings for Sewer Inlet;* 5,724,684, Paar, *Raised Strainer;* 7,300,573, Trangsrud, *Catch Basin Filter; D*606,174, Martin, *Debris Cage; and Des.* 388,725, Trampush, *Strainer for Downspouts*, various types of surface strainers are provided each having either an elevated portion very high above the surface, or offering only minimal allowance for the removal of large debris. The height of the devices claimed and shown in these patents makes them unsuitable for flat surfaces where pedestrians will walk or vehicles will traverse, as the devices will prove an impediment to safe travel.

In addition there are some drains made for the bottoms of pools that are also of a type having an elevation from a flat surface, such as that shown in U.S. Pat. No. 6,588,029, Mullings, *Safety Drain Guard for Swimming Pools and Spas* and 6,393,631, Schroader, *Drain Safety Cover System and Method*, and while larger openings are shown in combination with smaller openings, these drains are designed to clean the pool and not to drain a flat surface that is suppose to remain dry. Such systems are further designed to prevent persons from being trapped by suction on a pool drain and thus provide different levels of water intake so that vacuum created by suction can be broken more easily. Further, the designs have a similar flaw in that they are raised above the surface such that the use of such drains on flat dry surfaces would prove a hazard to travel; their placement in a swimming pool, particularly in the deep end, causes no such hazard.

Objects and advantages of the present invention will become apparent as the description proceeds.

SUMMARY OF THE INVENTION

In accordance with the present invention, a drain cover, for use on a drain opening in a generally flat surface is provided. The drain cover includes a plate having an aperture or opening thereon to permit water or other fluids to flow therethrough. The aperture encompasses a desired amount of area of the surface of the plate, such that sufficient water can flow therein to avoid flooding of the flat surface. The plate in a preferred embodiment has an edge about its perimeter and a skirt is attached to the edge of the plate and depends therefrom, the skirt having a lower edge for placement adjacent the generally flat surface and perforations therethrough to permit the flow of liquids. The drain cover can be positioned in a drain pipe on a surface to accept fluid through the plate aperture only when the perforations of its skirt are blocked and water rises above the skirt.

In one embodiment, the drain cover and aperture are of a sufficient size to accept large leaves through the aperture. The preferred embodiment of the drain cover of the present invention has a skirt length of between ⅜ inch and 1 inch; however as needed other sizes can be used. Preferred skirt heights of ½ inch and ¾ inch are envisioned for many situations. In a preferred embodiment the plate comprises a circular area and the skirt depends from the circumference thereof.

In one embodiment, the top of the device is generally open having an "X" shaped structural element spanning across diameters of the plate; thereby providing the largest apertures possible while also providing structural support for the drain cover and any large objects place or traversing thereon. The "X" shape of the element is such so as to provide great strength with as little material as possible to thereby have the largest openings for water. The structural element allows the device to be light weight, open to significant water flow and allows the device to be traversed by something as weighty as a person or a vehicle on a driveway. It will be understood that the "X" shape also prevents larger object, such as balls or children's toys or the like, from being brought into the drain or from jamming or blocking the drain.

The drain cover includes at least one leg, attached to the plate, depending therefrom for insertion into a drain pipe. Further, the at least one leg comprises a friction element for placement against the interior wall of a drain pipe allowing removable contact of the cover with the drain pipe. In a preferred embodiment the drain cover has four legs, at about 90 degrees from each other, with each having a friction element thereon.

In one embodiment, the drain cover further comprising a shutter system to close off the aperture(s) or opening(s); the shutter system can be operated manually or with sensors, microprocessors, motors and software or other elements, that can determine when opening and closing of the shutters is needed and to what extent for each drainage situation. The shutters of the present embodiment are movable within the device so as to adjust the size of the aperture while the drain cover is in place in the pipe.

In another embodiment of the present invention a drain cover having a generally cylindrical plate with an aperture or apertures thereon is provided. The aperture, or opening, covers an area of the plate comprising more than 50% of the surface of the plate so as to allow a large opening for water and debris to flow through. The plate of the present embodiment has an edge about its circumference and includes a perforated skirt depending from the circumference of the plate. The skirt has a lower edge for placement of the device adjacent the drainage surface so that the generally cylindrical plate is positioned to accept fluid through both the skirt openings and aperture only when the perforations of the skirt are either clogged or are otherwise insufficient to drain water, and water rises above the skirt. The drain cover of this embodiment has four legs with friction fit elements so as to help hold the device within a drainage pipe on a generally flat surface. The device of the present embodiment may also have a shutter or shutters to close the apertures or openings wherein in a preferred embodiment the shutters are rotatable, relative to the center of the plate, so as to adjust the effective size of the aperture. The preferred embodiment of this drain cover includes means to determine the optimal aperture opening and to adjust the aperture accordingly. Additionally the shutters may be made with perforations, akin to those on the skirt, such that when the shutters are closed the device provides additional drainage even when closed.

A more detailed explanation of the invention is provided in the following description and claims and is illustrated in the accompanying drawings.

DETAILED DESCRIPTION OF THE ILLUSTRATIVE EMBODIMENT

Figure 1:
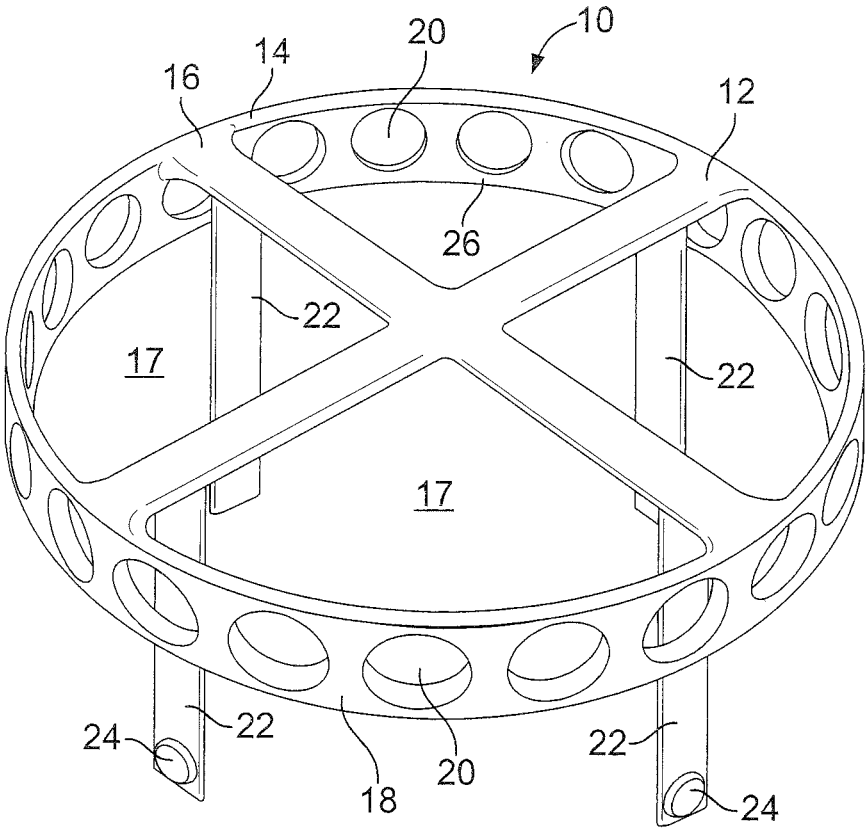
FIG. 1 is a perspective view of a drain cover of the present invention.

While the present invention is susceptible of embodiment in various forms, there is shown in the drawings a number of presently preferred embodiments that are discussed in greater detail hereafter. It should be understood that the present disclosure is to be considered as an exemplification of the present invention, and is not intended to limit the invention to the specific embodiments illustrated. It should be further understood that the title of this section of this application ("Detailed Description of an Illustrative Embodiment") relates to a requirement of the United States Patent Office, and should not be found to limit the subject matter disclosed herein.

Figure 2:
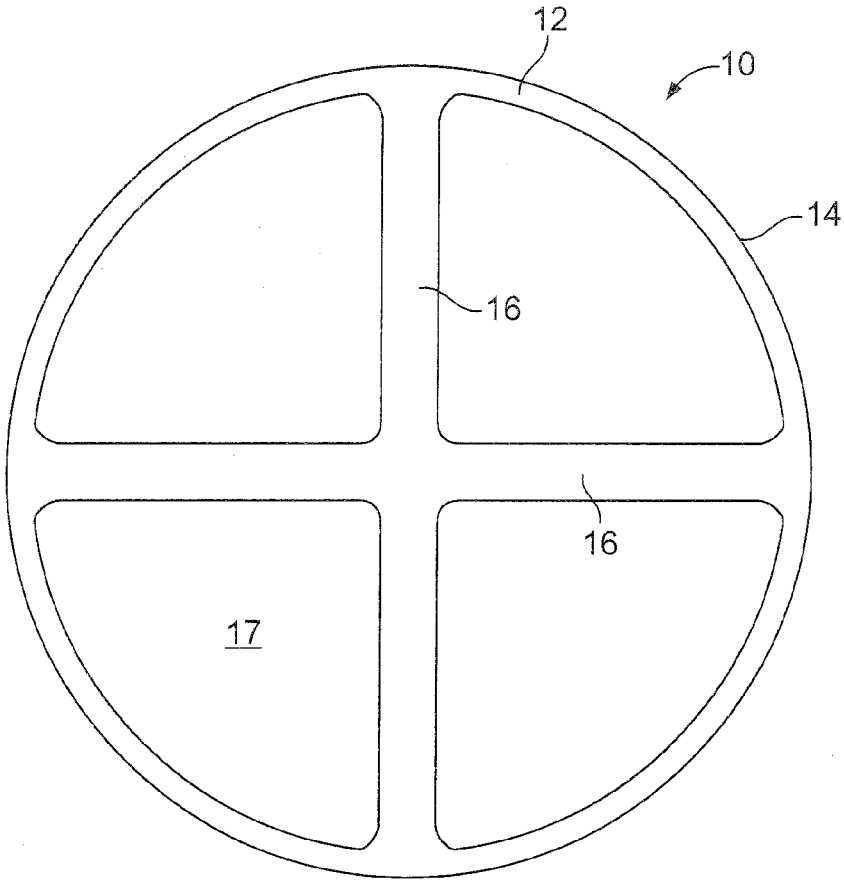
FIG. 2 is a plan view of the top of the drain cover of FIG. 1.
Figure 3:
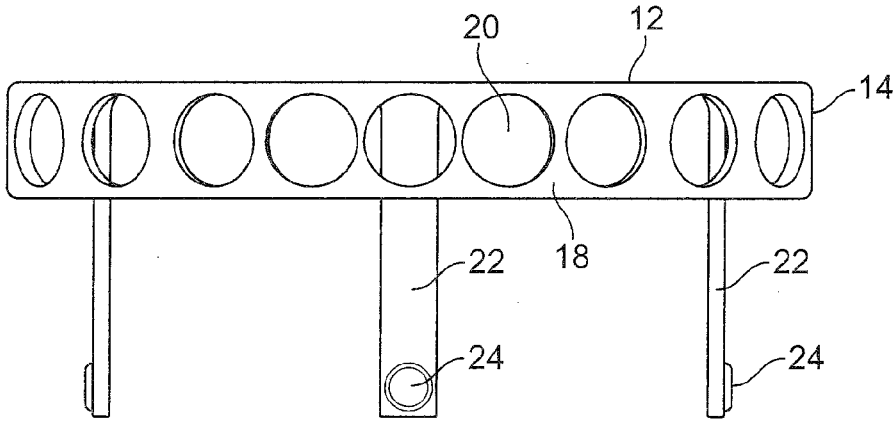
FIG. 3 is an elevational view of a side of the drain cover of FIG. 1.

Referring now to the drawings, it will be seen that FIGS. 1, 2 and 3 show a drain cover 10 of the present invention. It will be seen that drain cover 10 comprises a top surface 12 having a rim 14 and cross member supports 16. It will be understood that the top surface 12 can be configured in various manners, as will be shown in further figures and described herein, but that for the operation of the present invention a majority of the top surface will be generally large aperture or opening 17 allowing for the flow of liquid and solid matter into a drain that is covered by the present invention.

Figure 6:
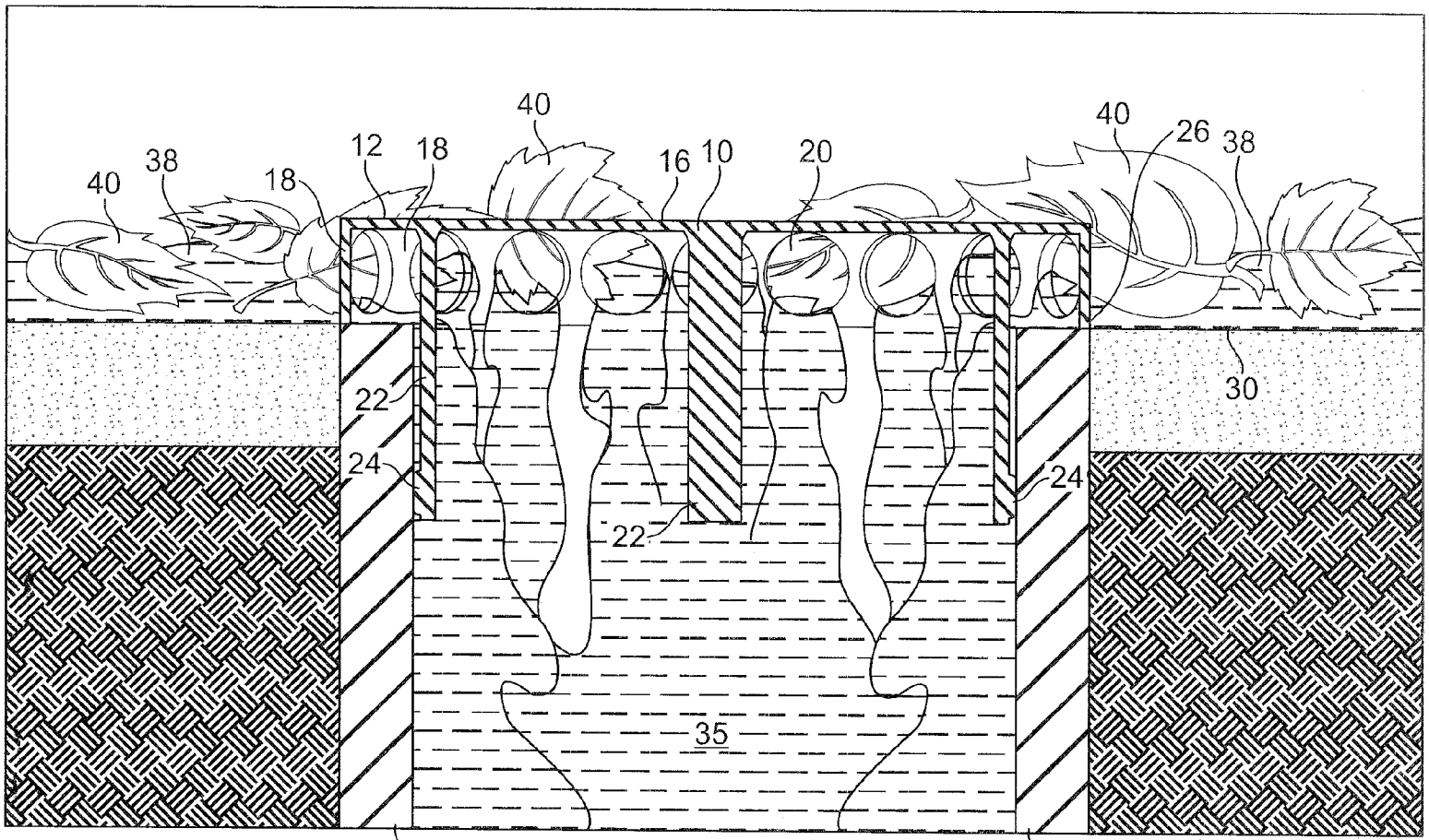
FIG. 6 is a cross-sectional view of a drain cover of the present invention in situ.
Figure 7:
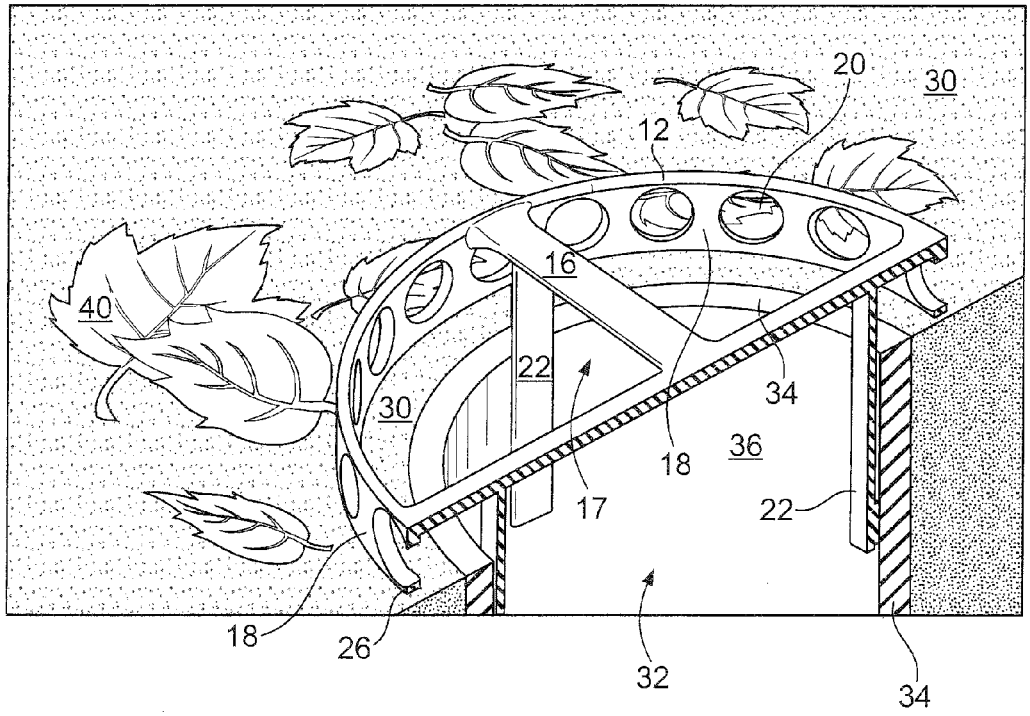
FIG. 7 is a cut-away perspective view of a drain cover of the present invention in situ.

It will be seen that drain cover 10 further comprises a depending skirt portion 18 having generally smaller openings 20 therein. Openings 20 are sized to allow fluid to drain therethrough but to block the flow of debris (as illustrated in FIGS. 6, 7 and 8) from entering the drain and flowing therethrough. It will be seen that the drain cover 10 of the present invention provides, therefore, an area for flow of fluids with a means to block debris and an area for flow of fluids with means to allow fluid to flow even if mixed with debris, as will be explained below.

In a preferred embodiment, drain cover 10 is formed of a structural-type steel, known to persons having skill in the art, such that the device is durable and will withstand the weight of objects, such as vehicles, traversing it as it sits on a flat surface. As the device is subjected to water and weather conditions, the preferred embodiment is constructed to withstand such, as well as the deleterious effects that weather has on objects. Persons having ordinary skill in the art will understand that the device can be constructed of any manner of material having the above noted characteristics, including, but not limited to steel, iron, aluminum, fiberglass, composites and other materials having durability and structural strength, without departing from the novel scope of the present invention.

Referring again to FIG. 1 drain cover 10 further includes depending legs 22 each having a friction element 24 extending therefrom. It will be seen that legs 22 are inset from the rim 14 of drain cover 10 in a manner that permits the legs 22 and friction elements 24 to fit into standard pipe internal diameters and, via friction elements 24, press against the interior diameter of a pipe so as to hold the drain cover in place in the pipe and with a bottom rim 26 of drain cover 10, resting against the surface 30 (FIGS. 4, 5, 6 and 7) of the surface to be drained.

Figure 4:
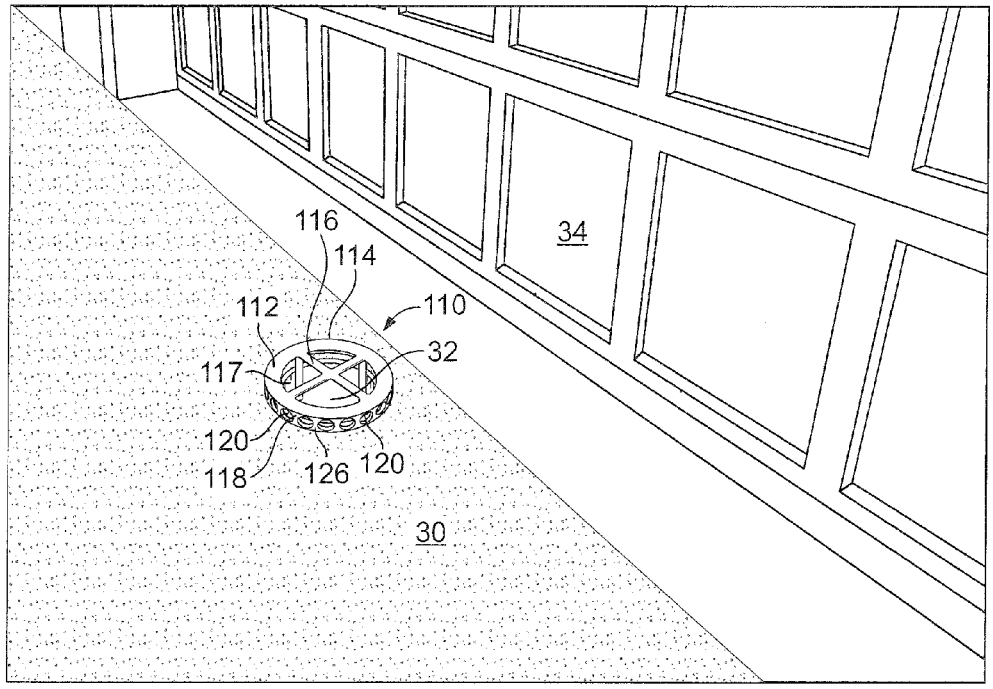
FIG. 4 is perspective view of another embodiment of the drain cover of the present invention in situ on a flat surface.
Figure 5:
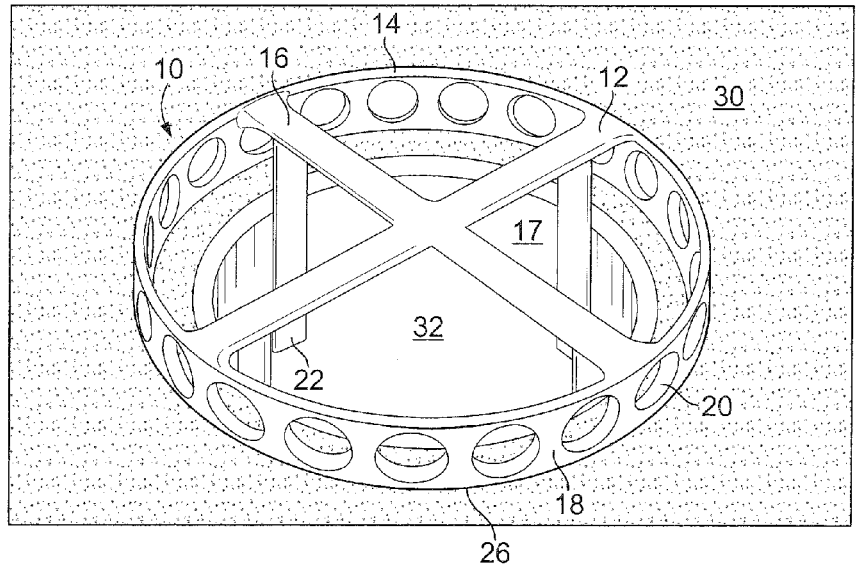
FIG. 5 is a perspective view of the drain cover of FIG. 1 in situ on a flat surface.
Figure 10:
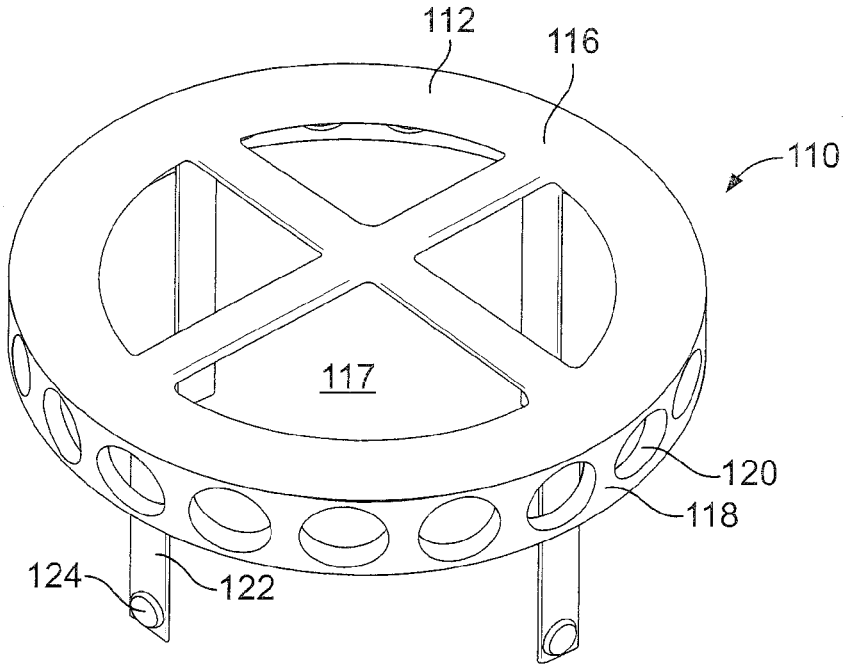
FIG. 10 is a perspective view of the drain cover of FIG. 4.

Referring now to FIG. 4, a generally flat surface 30, here shown as a driveway of a residence, is shown having a drain pipe 32 located on the flat surface 30. It will be seen that in this example, the flat surface 30 is a driveway in front of a garage door 34 (providing access to a garage structure and house or business, not shown). As illustrated, drain cover 110, is a variation of the device shown in FIG. 1, having a more solid upper surface area 112 extending radially in from the rim 114. Drain cover 110 can be more clearly viewed in FIG. 10. While drain cover 110 is shown and described here, and in FIG. 10, it will be understood that a drain cover 10, as shown in FIG. 1, could be substituted without departing from the novel scope of the present invention; such a configuration is illustrated in FIG. 5. It will be seen that drain cover 110 has elements similar to those shown for drain cover 10 in FIG. 5, with a similar numbering system for ease of understanding.

Referring to FIG. 5, for more clarity, drain cover 10 is seated on surface 30, with legs 22 within pipe 32 such that skirt 18 is seated on surface 30 at bottom rim 26. While bottom rim 26 is not sealed against surface 30, in the ordinary use of the present invention, it will be understood that such a union permits the flow of fluid under rim 26 but that debris, smaller than that permitted through opening 20 would likely be blocked at the described surface of contact. In other situations, persons having ordinary skill in the art will see that drain cover 10 can be sealed to surface 30 without departing from the novel scope of the present invention, if desired. In the illustrative configuration, it will be seen that skirt 18 rises above the surface 30 to a desirable height; in the preferred embodiment the height of skirt 18 is approximately ¾ inch. It will be understood that skirt 18, during periods of normal rain fall and small amounts of surface water, sufficiently permits water to drain through openings 20. Top surface 12, resting on skirt 18 and being above the flow of water in these conditions is not utilized and any debris on surface 30, which is caused to flow with the water, is trapped by openings 20 in skirt 18. Such debris can be subsequently brushed away to place the device in condition to drain during the next period of rain.

As shown in FIG. 4 drain cover 110 is provided with a smaller pattern of openings or apertures 117 on its top surface 112. It will be understood that any pattern of openings 117 can be provided without departing from the novel scope of the present invention. Such openings as slots, other shaped holes and others are well known in the art and some will be demonstrated below and in conjunction with FIGS. 8, 9 and 11.

Referring now to FIGS. 5, 6 and 7, it will be seen that a drain cover 10 is seated within pipe 32, which, as will be understood by persons having ordinary skill in the art, may be any type of drain pipe used to drain land or floor areas. Drain pipe 10 is a generally cylindrical pipe having walls 34 and an interior surface 35 and comes up through surface 30. Drain cover 10 rests on surface 30 at its bottom rim 26. It will be understood that the meeting of surface 30 and bottom rim 26 will not provide a water tight seal and that water heading towards the drain can enter between surface 30 and rim 26. It will be seen that drain cover 10 when inserted into drain pipe 32 is manufactured, in a preferred embodiment, such that legs 22 are adjacent to surface 35 and that friction elements 24 on legs 22 (FIGS. 1 and 6) touch surface 35 and form a frictional hold therewith; keeping drain cover 10 within drain pipe 34 until removal is desired.

When water 38, or other liquid, is present on surface 30 having drain pipe 32, water will generally proceed from the surface into the drain pipe. Water 38 and all loose material 40 carried thereon will freely enter drain pipe 32 and be carried to the terminus (not shown) of drain pipe 32. By placing drain cover 10 in the opening of drain pipe 32 water 38 and only small particles, having a size no greater than the size of openings 20, will be allowed to pass through the drain cover until the level of the water exceeds the height of drain cover skirt 18. When drain cover 10 is inserted within drain pipe 32, water will approach drain cover 10 and when the water reaches the opening 20, it will proceed to drain pipe 32. If leaves 40 or other debris is carried by the water to drain cover 10 openings 20 may be blocked, slowing the flow of water into drain pipe 32. When this occurs the surface of the water will continue to rise until it reaches opening 17 in the top surface 12 of drain cover 10 and then water 38 and leaves 40 and other debris will flow into drain pipe 32 through larger openings 17. In a preferred embodiment larger openings 17 have either an equivalent or greater surface area, as shown in FIG. 1, as the opening of pipe 32 so as to cause no additional hindrance to the drainage of surface 30.

It will be understood by persons having ordinary skill in the art that a drain cover of the prior art, having a generally flat profile (at or near the level of the surface to be drained) with openings thereon that are of the type shown in skirt 18 of the present invention, when presented with a generally flat surface to drain and on which surface lays debris such as leaves and the like, would clog in the presence of water (coming from a typical rain occurrence) allowing water to rise on the surface and potentially causing damage to adjacent structures and other property due to flooding. In the present invention a two prong approach to flooding is presented: a first fluid draining surface is presented in a generally vertical configuration with a second fluid and debris draining surface provided at a slight elevation on a generally horizontal configuration. When water is present alone or with very small sized debris, the first fluid draining surface adequately drains the area, and when larger debris is present and causes the first fluid draining surface to clog, the second fluid draining surface allows for the removal of water that could otherwise damage adjacent property.

The device of the present invention, when placed on a surface to be drained, provides the same type of drainage control as a flat perforated drain cover of the prior art, and, should clogging of the small entryways occur; permits the flow of larger debris and water into the larger opening in the elevated top surface. In this way, adjacent property, structures and items are given increased protection against water damage. The device, as described is made of structural materials so that if stepped on or driven over by a vehicle the device will remain intact and the dimensions of the preferred embodiment are such that the device does not present too great an obstacle for either pedestrians or vehicles.

Figure 11:
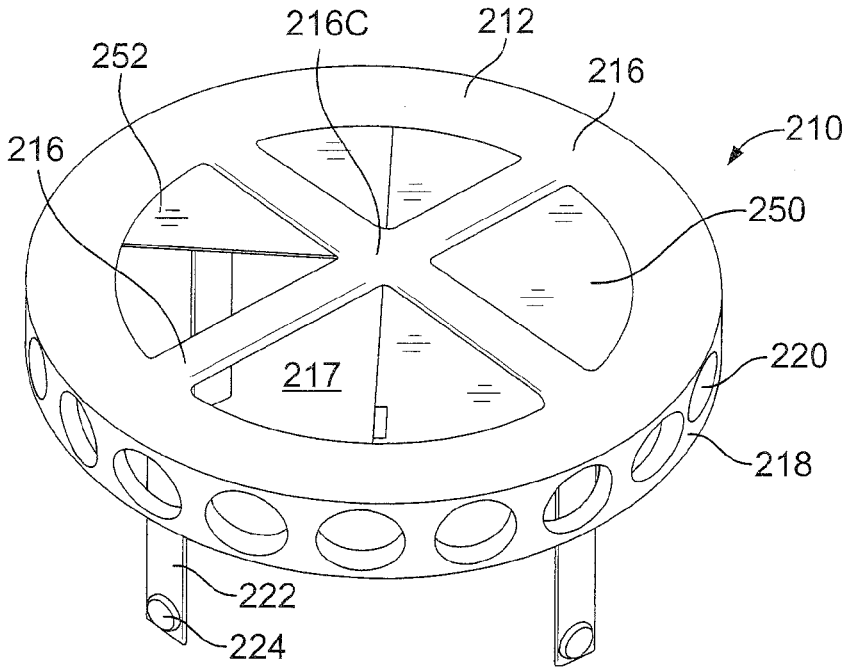
FIG. 11 is a perspective view of the drain cover of FIG. 8 (A-C).

In a further embodiment of the device of the present invention, a drain cover 210 is shown in FIGS. 8A, 8B, 8C and 11. It will be seen that the drain cover 210 of FIG. 8 is generally of the type shown in FIG. 4 and described above with like numbered elements having characteristics and functions as described for their counterparts above. Drain cover 210 is shown having a larger surface area 212 than that of corresponding portion of the device of FIG. 1. Further, as will be seen, the embodiments shown in FIGS. 8 and 11 further comprise a set of shutters 250, 252 attached by a pivot 254 to device 210 at about the center 216*c* of elements 216 (FIG. 11). It will be understood that shutters 250, 252 can be attached in various manners by persons having ordinary skill in the art without departing from the novel scope of the present invention. Shutters 250, 252 are placed so that they can pivot to close off large openings 217 such that if desired drain cover 210 can be utilized to drain fluids and smaller particles alone but not large debris. While the use of such a system will close one half of the draining surface 217, having the other half open will generally permit larger debris to be accepted within the pipe and thereby allow the drain to function in the presence of debris. The user of such a device can close more of the portion of the top draining surface 217 such that more than 50% up to 100% closure can be achieved as desired.

As illustrated, shutters 250, 252 are installed, in the preferred embodiment, under draining surface 217 so as to protect them from damage of a vehicle or persons traversing them. As drain cover 210 is generally a friction fit cover, the user may remove drain cover 210 from the drain pipe (32 in FIG. 5) adjust the shutters as desired and replace the cover in the drain opening. It will be understood that shutters 250, 252 could be closed or opened without removing drain cover 210 from the drain opening in various manners know to persons having ordinary skill in the art. In the use of drain cover 210, the user may adjust shutters 250, 252 to provide sufficient drainage for the conditions present and can also adjust the amount of drainage permitted by manipulation of the shutters. Should there be a requirement or other desire that large debris not be allowed in a drain, the user can close off the openings 217 fully and thereby comply with such requirements. In situations where large debris has value the ability to close off the larger openings 217 and thereby preserve the debris on the surface to be drained would be facilitated.

In another embodiment, a device 260 (FIG. 8A) is included and can include means to sense water flow and/or the presence of water or water pressure on surface 217 and have further means to open and close shutters 250, 252 as required to prevent flooding. It will be understood that device 260 can include remote sensing means or other means allowing the user to open and close shutters 250, 252 as desired locally or remotely or automatically in response to programmed criteria; such devices as device 260 are well known and can be adopted to permit any manner of functional, automated or remote control of the shutters to optimize drainage. In addition, the device can include means to lower or raise the depending skirt relative to the surface 30 such that as desired more or less flow of fluids and particles can be managed by making the device shorter or taller, respectively. The skirt 218 could be made to telescope into larger or smaller configurations, or a longer skirt can be made and placed lower into the drain opening and then raised as needed. Such means to telescope or raise or lower the device 260 could include manual, remote and automated means known to persons having ordinary skill in the art. Further, the device 260 can include means to notify the owner or another person of the presence of damaging water on the surface to be drained.

Figure 8A:
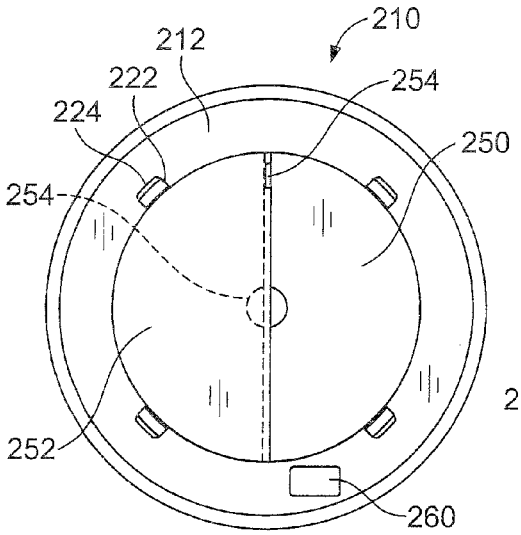
FIG. 8 (A-C) are plan views of the underside of another embodiment of the drain cover of FIG. 4.
Figure 8B:
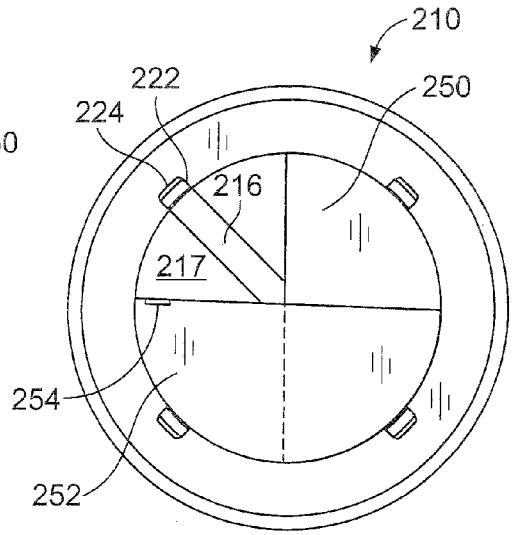
Figure 8C:
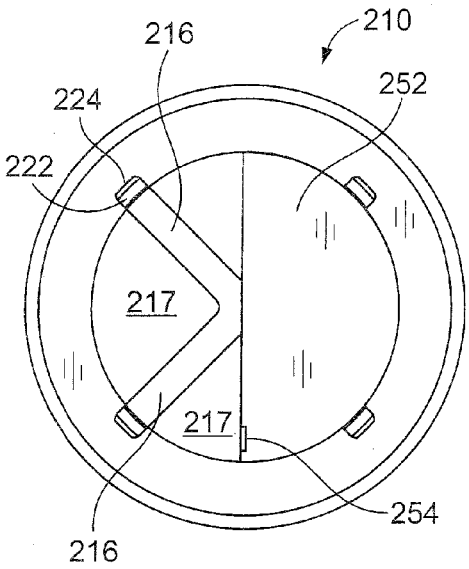

As shown in FIGS. 8A, 8B and 8C, respectively, the shutters can be completely shut, providing no access to large debris or can be shut, by the manipulation of one shutter with respect to the other, in various degrees between 50% open and completely shut. As illustrated, FIG. 8B shows a 75% shut configuration and FIG. 8C shows the 50% shut configuration.

Figure 9:
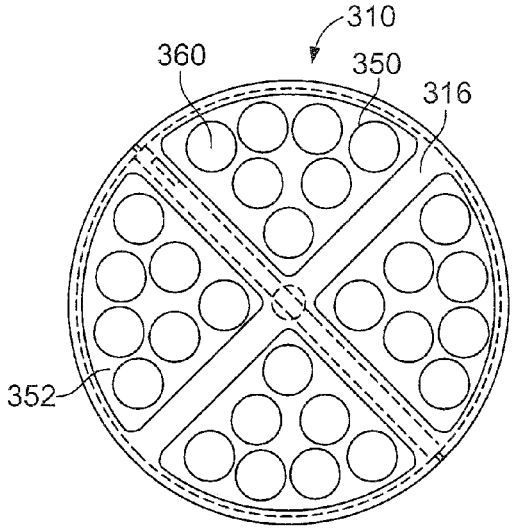
FIG. 9 is a plan view of another embodiment of the drain cover of FIG. 1.

In a further embodiment, illustrated in FIG. 9, shutters 350, 352 are illustrated having additional openings thereon, such that when opened drain cover 310 provides the same two level type of drainage described herein and when closed there is provide drainage akin to a standard drain having only small opening that block larger debris.

Although illustrative embodiments of the invention have been shown and described, it is to be understood that various modifications and substitutions may be made by those skilled in the art without departing from the novel spirit and scope of the invention.

What is claimed is:

1. A drain cover, for preventing debris from entering a circular drain opening in a generally flat drainage surface, said drain cover comprising:

a cylindrically shaped skirt having an inner diameter exceeding a diameter of said circular drain, said skirt having perforations therethrough to permit the flow of liquids into said drain opening;

a plate comprising an X shaped structural element including cross member supports attached to an upper end of said skirt, and traversing diameters of said skirt; and a plurality of legs integrally formed with, and extending perpendicularly from a lower side of said X shaped structural element, for insertion into, and engagement with an interior surface of said circular drain, wherein said plurality of legs, when inserted into said circular drain opening, prevent lateral movement of said drain cover.

2. The drain cover of claim 1, wherein debris can flow between said cross member supports of said plate and into said drain opening.

3. The drain cover of claim 1, wherein the spacing between said cross member supports of said plate is of a sufficient size to pass leaves therethrough.

4. The drain cover of claim 1, wherein said cylindrically shaped skirt has a height from an edge of the upper end to said drainage surface of about ½ inch.

5. The drain cover of claim 1, wherein said cylindrically shaped skirt has a height from an edge of the upper end to said drainage surface of about ¾ inch.

6. The drain cover of claim 1, wherein there are four legs.

7. The drain cover of claim 1, wherein at least one of said plurality of legs comprises a friction element for removable contact with an interior surface of said drain.

* * * * *